United States Patent [19]

Winters et al.

[11] Patent Number: 4,655,303

[45] Date of Patent: Apr. 7, 1987

[54] DRILL BIT

[75] Inventors: Warren J. Winters; J. Ford Brett, both of Tulsa; Tommy M. Warren, Coweta, all of Okla.

[73] Assignee: Amoco Corporation, Chicago, Ill.

[21] Appl. No.: 801,178

[22] Filed: Nov. 22, 1985

[51] Int. Cl.[4] ..... E21B 10/46; E21B 10/60

[52] U.S. Cl. ..... 175/329; 175/393

[58] Field of Search ..... 175/329, 393, 412, 409, 175/410, 400, 401, 398

[56] References Cited

U.S. PATENT DOCUMENTS

| | | | |
|---|---|---|---|
| 2,966,949 | 1/1961 | Wepsala, Jr. | 175/329 |
| 3,135,341 | 6/1964 | Ritter | 175/329 |
| 3,310,126 | 3/1967 | Ostalder et al. | 175/329 |
| 4,098,363 | 7/1978 | Rohde et al. | 175/329 |
| 4,554,986 | 11/1985 | Jones | 175/329 X |

FOREIGN PATENT DOCUMENTS

| | | | |
|---|---|---|---|
| 0929806 | 5/1982 | U.S.S.R. | 175/329 |

*Primary Examiner*—Stephen J. Novosad
*Assistant Examiner*—David J. Bagnell
*Attorney, Agent, or Firm*—Scott H. Brown; Fred E. Hook

[57] ABSTRACT

An improved drill bit and a method for making the same. A body having an upper end is adapted for connection to a source of rotary motion. A curved surface formed on the lower end of the body includes a plurality of cutting elements embedded therein. A port provides drilling fluid between the curved surface and the bore during drilling. The cutting elements and fluid courses formed on the curved surface define a gap between the surface and the bore during drilling. The gap is formed to provide no more than a substantially linear reduction in drilling fluid pressure with increasing bit radius. In making the bit, a bottomhole pattern and a substantially constant flow area are selected. Dimensions of the lower drill bit surface are calculated to provide the selected flow area over the surface when the bit is in position above the bottomhole pattern. Thereafter, the lower bit surface, including fluid courses thereon, is constructed in accordance with the calculated dimensions and diamonds are embedded therein to support the drill bit surface over the bottomhole pattern by a distance which produces the selected flow area.

5 Claims, 6 Drawing Figures

DRILL BIT

BACKGROUND OF THE INVENTION

1. Field of the Invention

The present invention relates to an improved drill bit and to a method for making the same and more particularly to such a drill bit of the solid body type having cutting elements embedded therein.

2. Setting of the Invention

In the drilling of oil and gas wells, rotary motion and downward force are applied to a drill bit to create a wellbore. The bit may be mounted on the lower end of a string of drill pipe which is rotated at the surface of the well or it may be mounted on a downhole hydraulic motor which in turn is suspended from a drill pipe string. In both types of drilling, the drill bit usually includes openings in the lower end thereof to enable circulation of drilling fluid down the pipe string, through the bottom of the bit, and upwardly into the annulus between the outer surface of the pipe string and the wellbore. The drill bit is rotated while the fluid circulation flushes cuttings from the bottom of the wellbore and cools the bit.

One type of drill bit which is used as described above includes a solid body having cutting elements embedded therein. Often the cutting elements on such drill bits are diamonds embedded in a lower curved surface on the bit. As the bit rotates, the diamonds cut the formation thereby increasing the depth of the bore. Friction of the diamonds sliding against the formation heats the diamonds. Diamond wear increases exponentially as the temperature of the diamond increases. It is important that drilling fluid flow around each diamond during drilling to minimize its temperature and thus its wear. Cuttings which adhere to the diamonds impede heat transfer so it is important to flush cuttings out of the bottom of the bore into the annulus.

In a conventional diamond drill bit, drilling fluid exits the center of the bit at the lower end thereof and flows toward the annulus between the drill string and the wellbore in a narrow gap between the lower end of the bit and the bottom of the bore. In such bits, the great majority of the hydraulic energy of the fluid is expended in the gap toward the center of the bit and very little of the energy is expended on the radially outer portions of the bit. The hydraulic energy or horsepower can be expressed as a product of the flow rate of the drilling fluid and the pressure drop. It can be theoretically proven that the cooling of each diamond is directly related to the hydraulic horsepower expended around the diamond. Thus, in a conventional drill bit, the diamonds toward the center of the drill bit are more than adequately cooled while the diamonds on the radially outer portions of the bit are inadequately cooled and thus subject to rapid wear. Since little of the hydraulic energy is expended on the outer portion of the bit, cuttings are more likely to adhere to the diamonds on the outer bit portions.

Conventional solid body drill bits suffer from other disadvantages. When such conventional bits are mounted on a downhole hydraulic motor, fluid is circulated down the drill string and through the motor thereby rotating the drill bit. Fluid continues through the bit out the bottom thereof and into the annulus. As the fluid flows from the drill string, through the bit and into the wellbore beneath the bit, an upward force is generated by the pressure differential between the inside and the outside of the bit. This force is directly related to the pressure drop beneath the bit and tends to reduce the weight applied to the bit as it increases. This force is commonly referred to as the "pump-off effect."

In copending applications filed by the inventors of the instant invention, description is made of the manner in which the pump-off effect is used to regulate the penetration rate of the drill bit. Such regulation is achieved by venting a selected amount of drilling fluid into the annulus rather than circulating it through the bit. It has been discovered that the greatest control of the pump-off force is achieved with bits that have the most pump-off force per unit of pressure drop across the bit. A bit which has a uniform distribution of hydraulic energy across its face will also have a high pump-off force per unit of pressure drop.

There exists a need for a solid body drill bit which has a uniform distribution of hydraulic energy across its face during drilling in order to uniformly cool the cutting elements on the face of the bit and to flush cuttings from beneath the bit.

There also exists a need for a drill bit having a high pump-off force per unit of pressure drop across the bit for use in drilling methods and apparatus in which the pump-off effect is used to control the penetration rate of the drill bit.

SUMMARY OF THE INVENTION

The present invention comprises a novel solid body drill bit and a method for making the same. The drill bit includes a body having an upper end adapted for connection to a source of rotary motion. A curved surface is formed on the lower end of the body and a plurality of cutting elements are embedded therein. At the curved surface, a port is formed for providing fluid between the surface and the bore during drilling. Spacing means define a gap between the bore and the curved surface when the bit is received in the bore. The gap is formed to provide no more than a substantially linear response in the reduction of fluid pressure, when fluid is so provided, with increasing bit radius.

In making such a bit, a bottomhole pattern and a substantially constant flow area are selected. Dimensions of the lower drill bit surface are calculated which provide the selected flow area over the surface when it is in position above the bottomhole pattern. Thereafter the lower drill bit surface is constructed in accordance with the calculated dimensions. Means for spacing the lower drill bit surface from the bottomhole pattern are mounted on the lower drill bit surface. The spacing means support the drill bit surface over the bottomhole pattern by a distance which produces the substantially constant flow area. These spacing means also serve as the cutting elements.

The present invention is particularly useful for high speed drilling powered by a downhole hydraulic motor.

DETAILED DESCRIPTION OF THE PREFERRED EMBODIMENT

The present invention provides an improved solid body drill bit and a method for making the same. The gap between the lower end of the bit and the bore is defined by cutting elements embedded in the body of the bit and may be further defined by fluid courses formed on the body of the bit. The gap is sized to provide no more than substantially linear reduction in fluid pressure, when fluid is pumped through the bit during drilling, with increasing bit radius.

Figure 1:
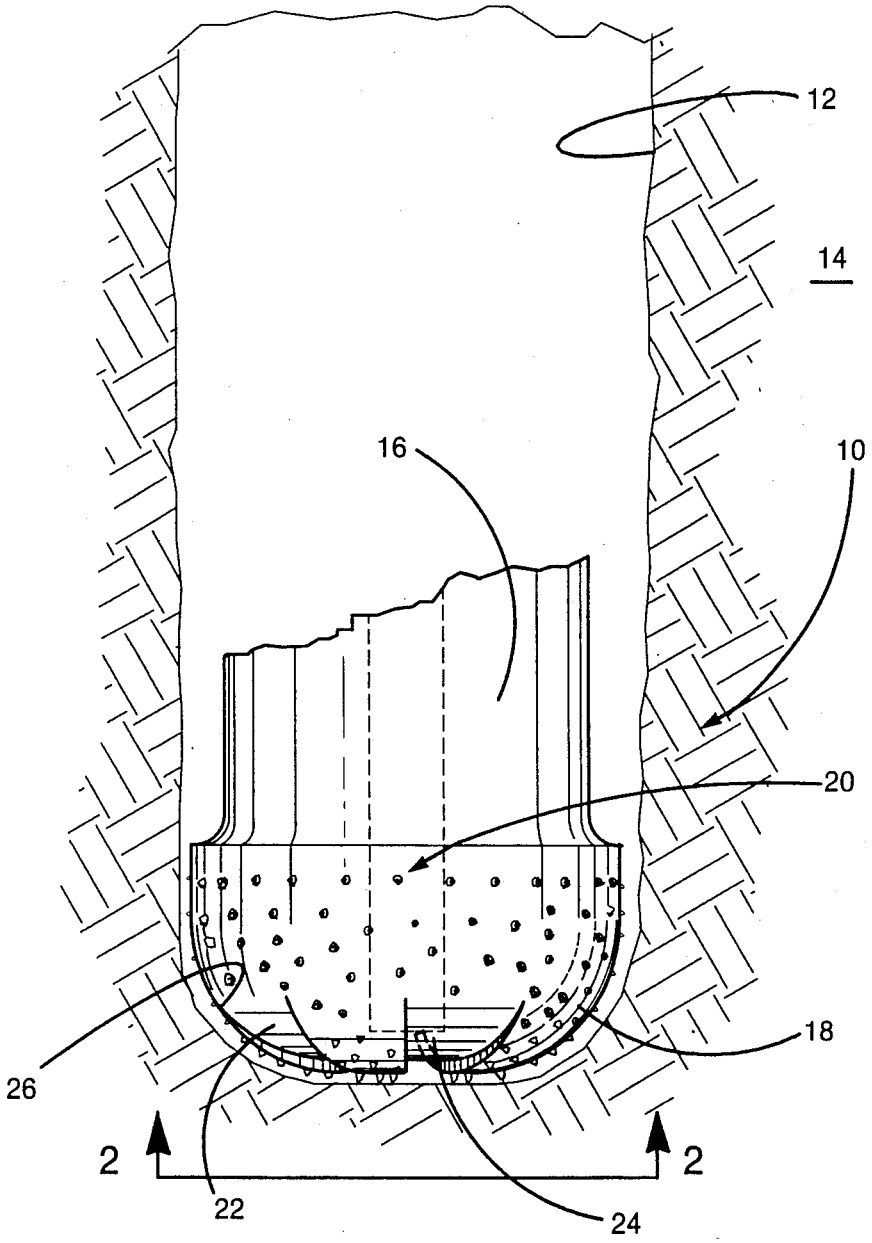
FIG. 1 is an elevational view of a preferred embodiment of the drill bit of the invention in a wellbore.

Turning now to FIG. 1, indicated generally at 10 is a drill bit constructed in accordance with the invention. Drill bit 10 is received within a wellbore 12 formed in formation 14. The bit includes an upper end 16 which is connected to a commercially available downhole hydraulic motor which in turn is suspended from a string of drill pipe in the wellbore. The lower end of the drill bit includes a curved surface 18 having a plurality of cutting elements, in the instant embodiment such being a plurality of diamonds (indicated generally at 20), embedded therein.

A plurality of channels or fluid courses, two of which are fluid courses 22, 24, are formed on surface 18. The fluid courses, to be described in more detail hereinafter, are recessed areas which serve to direct drilling fluid across the face of the bit. A gap 26 exists between curved surface 18 and the bottom of the wellbore for two reasons: first, diamonds 20 are not completely embedded in formation 14 and thus support the curved surface above the surface of the bore. Secondly, the fluid courses are recessed and thus that portion of surface 18 within each fluid course is spaced away from the bottom of the bore.

Figure 2:
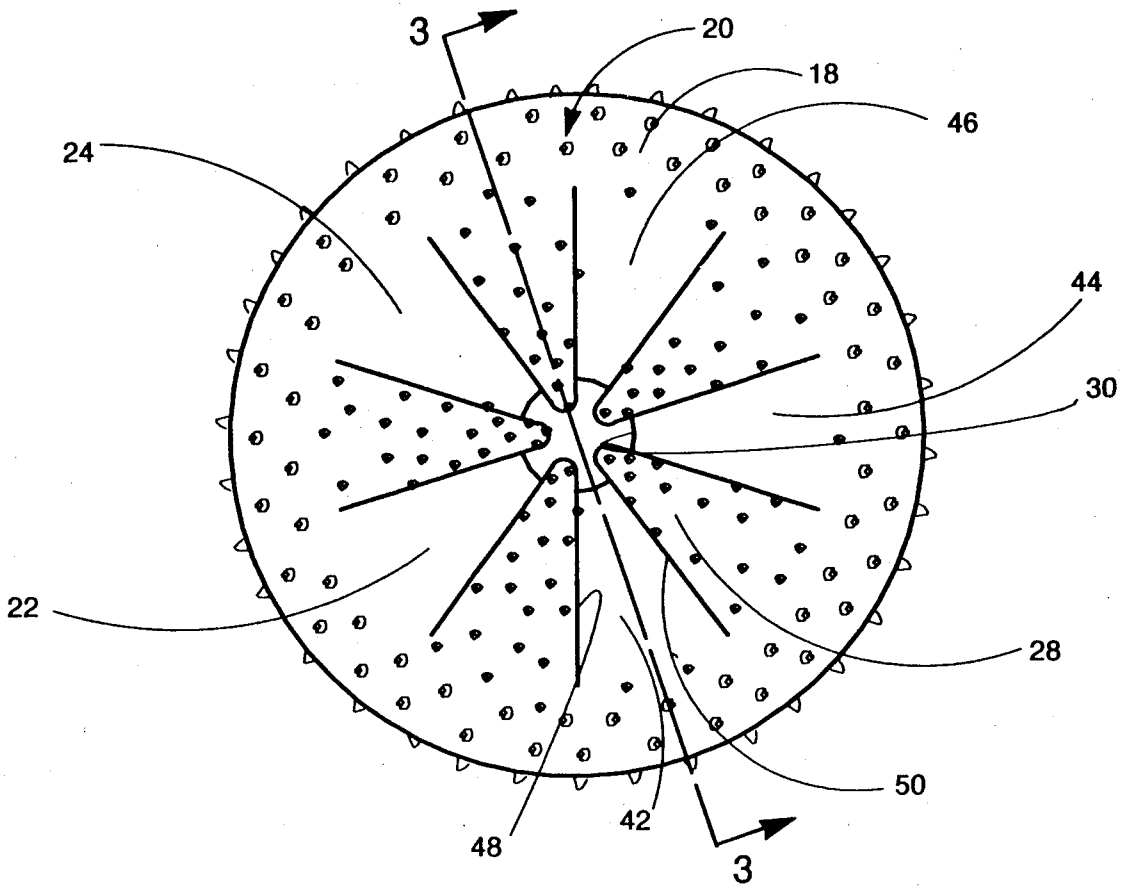
FIG. 2 is a bottom plan view of the drill bit shown in FIG. 1.
Figure 3:
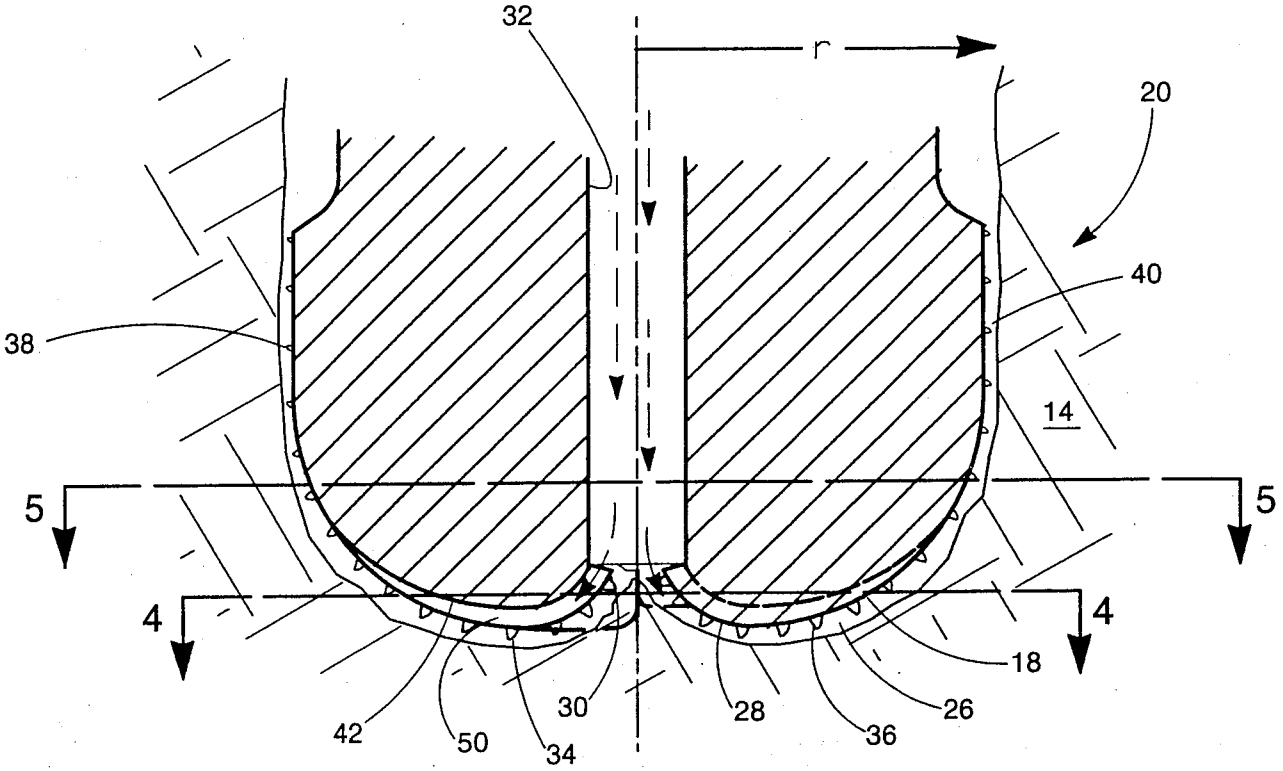
FIG. 3 is a cross-sectional view taken along lines 3—3 in FIGS. 1 and 2.

For a more detailed view of the lower portion of the drill bit, attention is directed to FIGS. 2 and 3. Curved surface 18 includes a recessed portion 28 which is somewhat inverted conical in shape. Port 30 is formed in the center of the lower end of the bit and is in fluid communication with a bore 32 formed through the bit on the central axis thereof.

Figure 4:
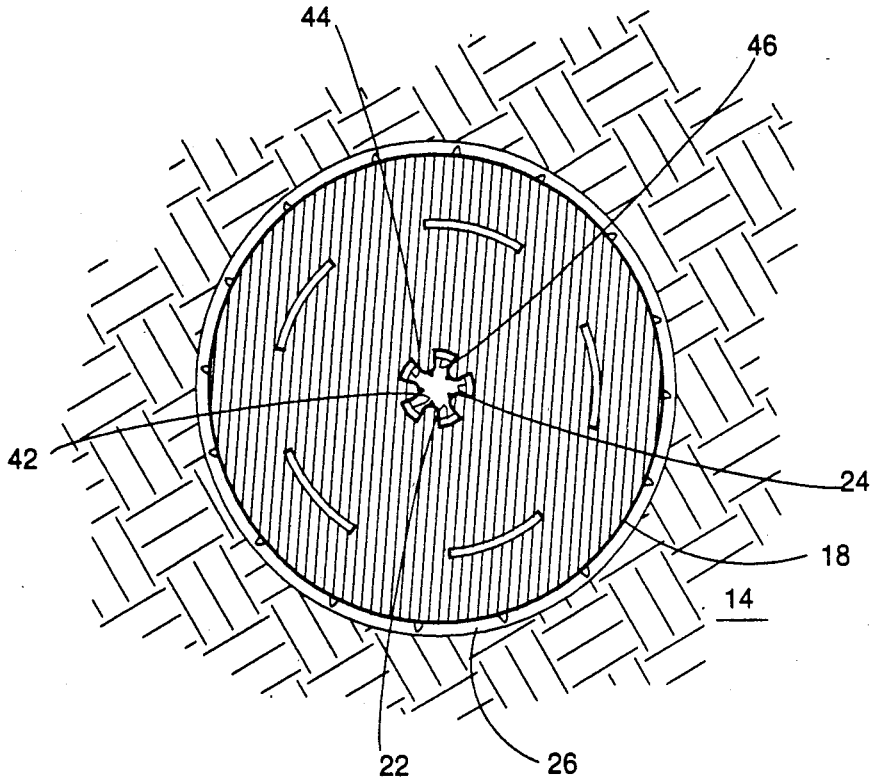
FIG. 4 is a cross-sectional view taken along line 4—4 in FIG. 3.
Figure 5:
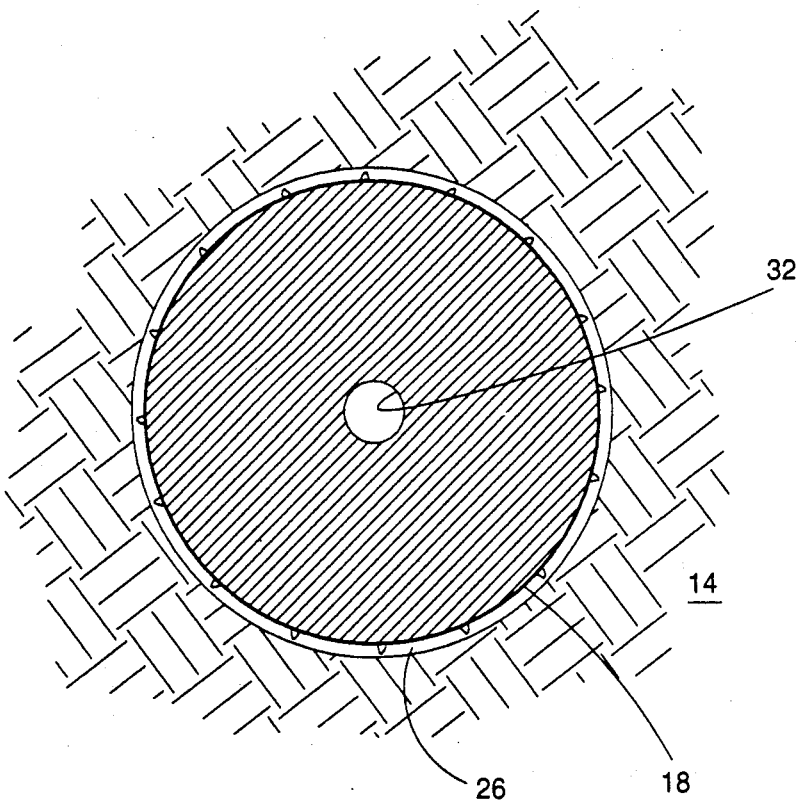
FIG. 5 is a cross-sectional view taken along line 5—5 in FIG. 3.

As can be seen in FIGS. 1 and 2, diamonds 20 are substantially uniformly distributed over the lower surface of the drill bit. As is best viewed in FIG. 3, the extent to which each diamond extends above curved surface 18 varies, with the greatest extension occurring for diamonds near the center of the bit and the least extension occurring for diamonds at the outer edge of the bit. For example, diamonds 34, 36 extend further above surface 18 than do diamonds 38, 40. The extent to which each diamond extends above surface 18 gradually diminishes between the inner and outer portions of curved surface 18. Thus, it can be seen that the depth of gap 26, i.e., the distance between the bottom of the bore and curved surface 18, likewise gradually diminishes from the inner to the outer portions of the bore. The diminishing diamond and gap sizes can also be observed in FIG. 4 in which the diamonds, and the gap, which are toward the center of the drill bit are larger than the diamonds and gap on the outer edge of the drill bit. Likewise in FIG. 5, showing gap 26 at a distance radially outwardly from the views of the gap in FIG. 4, the gap size and diamond sizes are further decreased.

Turning again to FIG. 2, in addition to fluid courses 22, 24, fluid courses 42, 44, 46 are also formed on curved surface 18. Each of the fluid courses begins adjacent port 30 and extends radially outwardly therefrom. Each fluid course includes a pair of opposing sides, like sides 48, 50 in fluid course 42. Side 50 of fluid course 42 is also viewable in FIG. 3. The sides of each fluid course diverge with increasing distance from the center of the bit. In addition, the depth of each fluid course, such being the height of a side of a fluid course at a selected location, decreases with increasing distance from the center of the bit. This can best be observed in FIG. 3 for fluid course 42. As the distance from the center of the bit increases, the height of the wall of side 50, i.e., the depth of course 42, tapers to the end of the fluid course as shown.

In operation, drill bit 10 is rotated under action from the hydraulic motor (not shown) on which it is mounted. As the bit rotates, diamonds 20 gouge cuttings from formation 14 thus increasing the depth of the bore. Friction between the diamonds and the formation heat the diamonds. In order to cool the diamonds, drilling fluid is pumped down bore 32, such being indicated by arrows in FIG. 3, and out port 30.

The fluid enters gap 26 and the fluid courses, and thus is distributed over curved surface 18 to cool each of the diamonds. The gap is sized such that fluid is also forced to flow across diamond pad 38. Thereafter, the fluid and the formation cuttings, which are flushed away from the drill bit by the fluid, flow upwardly to the surface of the well in the annulus between the drill string and wellbore.

The hydraulic energy or horsepower expended by the fluid as it passes between port 30 and the annulus of the wellbore may be calculated by multiplying the flow rate times the pressure differential between the fluid at port 30 and the fluid in the annulus. This calculation may also be made between port 30 and any selected distance along curved surface 18. The horsepower can be expressed as horsepower per square inch of bit surface area (H.S.I.) by dividing the calculated energy by the bit surface area defined by the surface of rotation of the line between the bit center and the point at which pressure is measured. Since the flow rate is constant over any annular ring on the bit, e.g., through gap 26 as viewed in FIG. 4, if the pressure gradient is constant with respect to bit area, H.S.I. is also constant. When H.S.I. is constant, an equal amount of hydraulic energy is expended around each diamond, thus uniformly cooling the diamonds and flushing the cuttings from the bottom of the bit.

In the instant embodiment of the invention, the pressure gradient per unit of curved surface 18 area is substantially constant due to the reduction of the depth of gap 26 with increasing bit radius. As used herein the term "bit radius" refers to the distance measured at right angles from the longitudinal bit axis (shown in dashed lines in FIG. 3) to a selected point on curved surface 18. The gap is reduced by the decreasing distance by which each diamond extends above curved surface 18 with increasing bit radius and by the decreasing depth of each fluid course, also with increasing bit radius.

In the instant drill bit, the decrease in gap 26 is such that a constant flow area is maintained for any selected bit radius. The term "flow area" as used herein refers to the total area through which fluid flows at any selected annular bit ring, e.g., the area between curved surface 18 and the bore as viewed in FIG. 5. Thus, in FIG. 4, the flow area shown which includes the water courses equals the flow area of the radially outer portion of gap 26 in FIG. 4 and also equals the flow area of the further radially outward portion of gap 26 in FIG. 5. The decrease in gap size from the radially inner to the radially outer portions of the bit surface can be observed in FIGS. 4 and 5. A bit having graduated diamond sizes as in the instant embodiment of the invention (but no fluid courses) could be designed to have a constant H.S.I. as explained herein if a sufficiently small flow area is selected. Inclusion of water courses enables the use of a larger flow area and thus permits more fluid to cross the bit face per unit of time.

Figure 6:
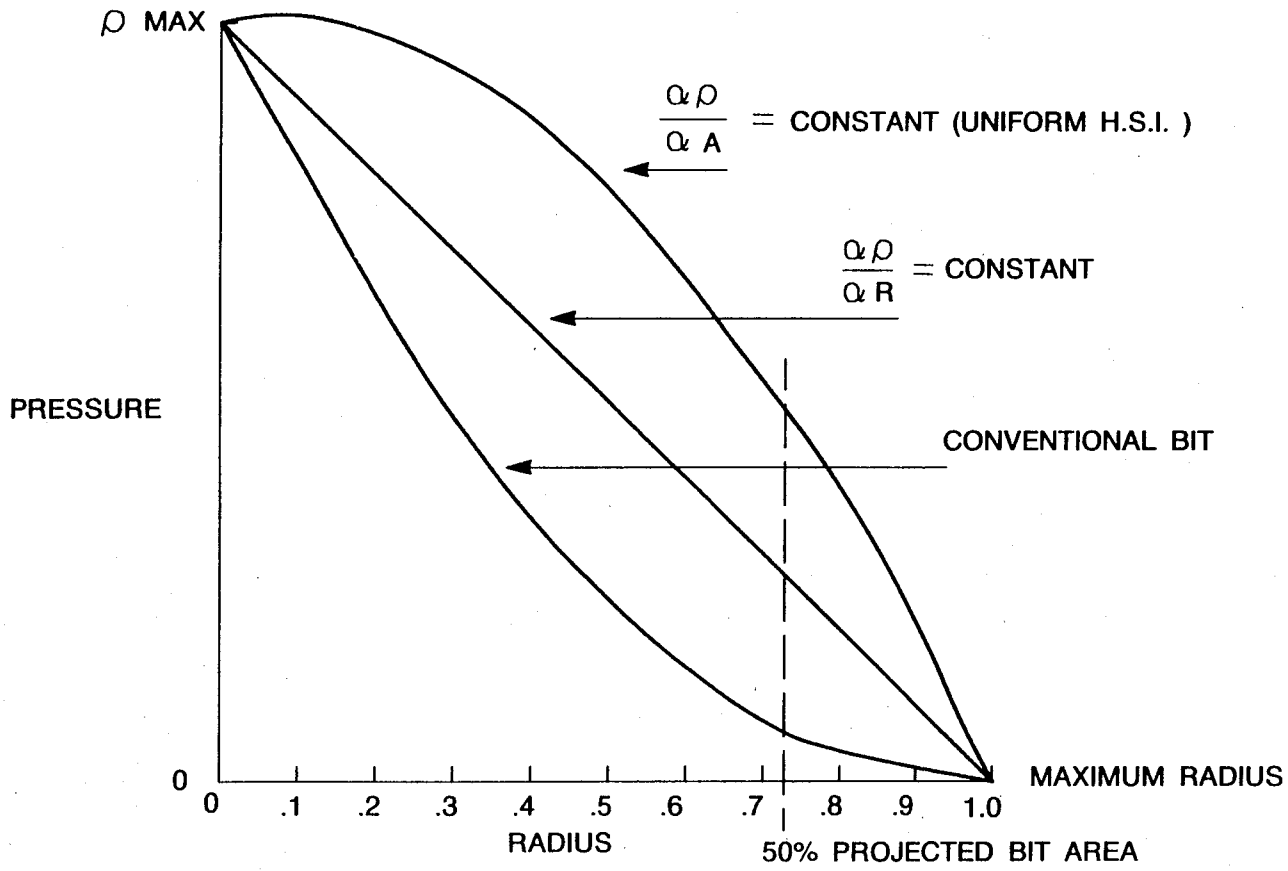
FIG. 6 is a graph showing, for three different drill bits, the pressure of drilling fluid between the lower end of the bit and the bore at various radiuses from the center of the bit.

The chart in FIG. 6 shows pressure measurements at various radial distances along the surface of the bit for 3 different drill bits. As can be seen for each of the bits, the fluid pressure is high in the center of the bit and low at the outer edges of the bit. The dashed vertical line in the chart represents the radius for each bit which contains half of the bit face area as projected on a circle on the bottom of the bore. The other half of the bit face area is located radially outwardly from the radius marked in the chart.

It can be seen that for a conventional bit substantially all of the pressure drop, and thus the hydraulic energy, is expended on the inner half of the bit area. Thus, the outer portions of the bit are not being adequately cooled by the drilling fluid. The upper line in the graph represents the measurements for the instant embodiment of the invention. It can be seen that substantially half of the pressure drop, and thus of the hydraulic energy, occurs on the inner portion of the bit and half on the outer portion thereof. Thus, hydraulic energy is uniformly distributed across the face of the bit. The straight line represents measurement for a bit which is designed to have a linear reduction in hydraulic energy with increasing bit radius. While more than half of the hydraulic energy is expended on the inner face of the bit, the straight-line bit still expends at least three times the energy on the outer bit area as does the conventional bit.

A fundamental characteristic of a bit having a substantially uniform distribution of hydraulic energy across its face is that it has a large pump-off area, i.e., a large pump-off force per unit of pressure drop. The total bit pressure drop between port 30 and the annulus can be in the moderate range compared to pressure drops applied to conventional bits and will still result in improved diamond cleaning and cooling because of the improved energy distribution. Even with these moderate pressure values, the bit still has a higher pump-off force than conventional bits and thus is ideal for use in systems, like those disclosed by the inventors herein in their copending applications, which vary the pump-off force to control penetration rate.

In making the instant embodiment of the bit, the bottomhole geometry is arbitrarily selected to be as shown in FIG. 3. Although this is a substantially arbitrary selection, consideration is given to the fact that the circular arcs help provide constant bit cutter contact with the formation even when the axis of the bit tilts away from the axis of the bore. After selection of the bottomhole pattern, a flow area of a sufficient size to permit adequate diamond cooling is selected. Once the shape of the bottom of the bore and the flow area is selected, the size of the gap between the bottom of the bore and curved surface 18 may be calculated by a person having ordinary skill in the art. Thereafter, a bit body having the calculated geometry is built and diamonds are embedded therein so as to support the bit surface by a height equal to the calculated gap size at each point on curved surface 18.

If fluid courses must be used in order to define a flow area sufficient to adequately cool the diamonds, the calculations of the geometry of curved surface 18 include the width and number of fluid courses as arbitrary selections with the depth of each fluid course being calculated to provide the selected flow area. After a bit body having fluid courses sized in accordance with the calculations is made, diamonds extending above curved surface 18 by varying amounts as shown in FIG. 3 are provided in order to produce the calculated gap size at all locations on the bit face.

It must be appreciated that additions and modifications may be made to the instant embodiments of the method and apparatus of the invention without departing from the spirit thereof which is defined in the following claims.

What is claimed is:

1. A drill bit for use in drilling a bore, comprising:

a body having an upper end adapted for connection to a source of rotary motion and a curved surface formed at a lower end thereof;

a plurality of cutting elements imbedded in and extending above the curved surface, the distance the cutting elements extend above the curved surface decreases with increasing distance from the center of the curved surface;

a port formed in the body for providing fluid therethrough to the curved surface; and a plurality of fluid courses formed in the curved surface for distributing fluid from the port across the curved surface in a manner where there is a substantially linear reduction in fluid pressure with increasing distance from the port.

2. The drill bit of claim 1 wherein the port extends longitudinally through the center of the body.

3. The drill bit of claim 1 wherein the depth of the fluid courses decreases with increasing distance from the port.

4. The drill bit of claim 1 wherein the width of the fluid courses increases with increasing distance from the port.

5. The drill bit of claim 3 wherein the fluid courses extend from the port to a point adjacent an outer cylindrical surface of the body.

* * * * *